United States Patent [19]

Delmore

[11] Patent Number: 4,649,279

[45] Date of Patent: Mar. 10, 1987

[54] NEGATIVE ION SOURCE

[75] Inventor: James E. Delmore, Idaho Falls, Id.

[73] Assignee: The United States of America as represented by the United States Department of Energy, Washington, D.C.

[21] Appl. No.: 821,202

[22] Filed: Jan. 23, 1986

Related U.S. Application Data

[63] Continuation of Ser. No. 606,038, May 1, 1984, abandoned.

[51] Int. Cl.[4] ..... H01J 27/20

[52] U.S. Cl. ..... 250/427; 250/424; 315/111.81

[58] Field of Search ..... 376/129; 315/111.81; 250/423 R, 424, 427

[56] References Cited

U.S. PATENT DOCUMENTS

| | | | |
|---|---|---|---|
| 2,935,634 | 5/1960 | Lerbs | 313/63 |
| 4,213,043 | 7/1980 | Dawson | 250/283 |
| 4,303,865 | 12/1981 | Swingler | 250/423 R |
| 4,329,586 | 5/1982 | Dagenhart et al. | 250/426 |
| 4,486,665 | 12/1984 | Leung et al. | 250/427 |

OTHER PUBLICATIONS

Delmore, "Isotopic Analysis . . . ", *International Journal of Mass Spectrometry and Ion Physics*, 43(1982) 273–281.

*Primary Examiner*—Bruce C. Anderson
*Assistant Examiner*—Jack I. Berman
*Attorney, Agent, or Firm*—Bruce R. Mansfield; Paul A. Gottlieb; Judson R. Hightower

[57] ABSTRACT

A method and apparatus for providing a negative ion source accelerates electrons away from a hot filament electron emitter into a region of crossed electric and magnetic fields arranged in a magnetron configuration. During a portion of the resulting cycloidal path, the electron velocity is reduced below its initial value. The electron accelerates as it leaves the surface at a rate of only slightly less than if there were no magnetic field, thereby preventing a charge buildup at the surface of the emitter. As the electron traverses the cycloid, it is decelerated during the second, third, and fourth quadrants, then reeccelerated as it approaches the end of the fourth quadrant to regain its original velocity. The minimum velocity occurs during the fourth quadrant, and corresponds to an electron temperature of 200° to 500° for the electric and magnetic fields commonly encountered in the ion sources of magnetic sector mass spectrometers. An ion source using the above-described thermalized electrons is also disclosed.

14 Claims, 4 Drawing Figures

NEGATIVE ION SOURCE

CONTRACTUAL ORIGIN OF THE INVENTION

The United States Government has rights in this invention pursuant to Contract No. DE-AC07-79IDO01675 between the U.S. Department of Energy and Exxon Nuclear Idaho Company, Inc.

This is a continuation of application Ser. No. 606,038 filed May 1, 1984, now abandoned.

BACKGROUND OF THE INVENTION

This invention pertains to arrangements for producing negative ions and in particular to negative ion sources suitable for use with mass spectrometers and other instruments having significantly large minimum ion velocity requirements.

In 1938, Bleakney and Hipple reported a positive ion cycloidal mass spectrometer (Physics Review, 53 (1938) 521) which utilized crossed electric and magnetic fields to separate positively charged particles into a mass spectrum. A major problem with this type of instrument has proven to be the attendant decrease in ion velocity, which causes difficulties in focusing the instrument. As a result, the cycloidal mass spectrometer has been largely abandoned in favor of other mass spectrometer arrangements.

Conceptually, negative ion mass spectrometers are also fraught with problems. One particular problem has been that of providing a suitable source of negative ions in which the ionizing electron stream is prevented from being merged with the end-product negative ions, during acceleration of those negative ions into the mass spectrometer. Generally, a gas source is subjected to an electron stream in a way that enhances electron capture by the particles. One way to insure such enhancement is to limit the electron stream to thermal velocities. However, even the most efficient capture rates are of the order of less than one percent, and the uncaptured 99-plus percent of the electron stream comprises possible candidates for acceleration within the negative ion accelerator stage. One major problem with negative ion instruments has been the inability to prevent the introduction of electrons into the negative ion stream.

The capture of an electron by most gaseous molecules to form negative ions is a favored process only when the electron has near-thermal kinetic energy, except for a few molecular species which have resonances at intermediate energies. Heretofore, thermalization has generally been accomplished by accelerating an electron from a hot filament into a relatively high pressure gas, wherein the electron loses kinetic energy by multiple collisions. The drawback to this technique, when utilized with mass spectrometers and the like, is the required differential of a high pressure in the ion source and a low pressure in the analyzer sections of the mass spectrometer. This requires extensive differential pumping. The method of cooling electrons, that has been used almost excusively to date is entitled "Negative Chemical Ionization" (NCI). In this method, negative ions produced in a high pressure gas source are introduced into an analyzer which typically operates at a high vacuum, thereby requiring a pressure drop at the source-analyzer interface of about eight orders of magnitude. This pressure differential causes major problems which can only be partially overcome at great expense. A method for thermalizing electrons that is more readily compatible with high vacuum instruments would be desirable for certain types of negative ion studies, since there are a wide range of electronegative molecules that are best analyzed as negative ions.

A recently published method by J. E. Delmore (inventor of the present invention) [*International Journal of Mass Spectrometry Ion Physics,* 43 (1982) 71] uses electrons as they are emitted from a hot filament, for electron capture studies with $SF_6$. The minimum emitter temperature at which a minimum usable electron current of a few microamperes can be generated is 1300 K, so even at these conditions the electrons are more energetic than might be desired. Also, in this method, the electrons spend little time at this minimum energy, prior to being accelerated by the lens, and the hot filament can cause molecular decompositions that yield ion fragments at the effective ionization region of the source. A method for reducing the kinetic energy of an electron to less than that at which it is emitted, at a location within the ionization region of the ion source (which is some distance from the emitter) would be advantageous. Simple retardation lenses are not suitable at the 0.05–0.20 eV levels corresponding to an electron temperature of several hundred degrees centigrade, due to space charge buildup.

It is therefore an object of the present invention to provide a source of negative ions in which a supply gas is made to capture electrons.

Another object of the present invention of the present invention is to provide a negative ion source which preferentially accelerates negative ions without accelerating the ionizing electrons.

Yet another object of the present invention is to provide a negative ion source in which ionizing electrons are prevented from being appreciably accelerated when placed in an accelerating field which extracts the negative ions thus formed.

Another object of the present invention is to provide a negative ion source in which appreciable residence times for ionizing electrons in thermal energy ranges is realized.

Yet another object of the present invention is to provide an arrangement for reducing the kinetic energy of electrons emitted from a hot filament to energy levels less than that of the emission energy, and in regions where particle ionization takes place.

Still another object of the present invention is to provide a negative ion source which ionizes gaseous particles at a pressure roughly equivalent to the operating pressure of downstream instruments which utilize such negative ions.

These and other objects of the present invention are provided in a negative ion source in which an elongated strip-like electron emitting filament is located at right angles to a downstream draw-out electrode. A gas stream to be ionized passes adjacent to the filament, and through an aperture in the draw-out electrode. The draw-out electrode is energized at a positive potential, relative to the filament. Thus, an electric field is directed from the filament toward the draw-out electrode. A shield electrode is located adjacent the filament, and extends generally parallel thereto. The gas stream passes between the filament and the shield electrode, in an ionization region of the ion source. A magnetic field placed within the ionization region extends perpendicular to the electric field, in a direction generally parallel to the axis of the filament. Electrons emitted from the filament travel through the ionization in cycloidal orbits, in a direction mutually orthogonal to both the electric and magnetic fields. The electrons are slowed down to thermal energy levels while traversing the cycloidal orbits, a feature which enhances electron capture by the gas stream. The resulting negative ions are preferentially accelerated out of the ionization region, leaving unaccelerated electrons to remain in the ionization region.

In a method of the present invention, negative ions are produced for use in a negative ion instrument which includes an ion lens having a focus and a focal axis. An electric field, aligned parallel to the focal axis, is provided. Also provided is a magnetic field aligned perpendicular to the electric field. An input gas is made to flow past an electron emitter, toward the ion lens. The emitter is energized, causing electrons to be emitted therefrom in cycloidal orbits, traveling in a direction mutually orthogonal to the electric and magnetic fields. The input gas is directed across the cycloidal orbits of the electrons such that the electrons are captured by the input gas, producing negative ions. Thereafter, negative ions are preferentially accelerated toward the ion lens, causing the electrons to remain behind.

DETAILED DESCRIPTION OF THE PREFERRED EMBODIMENT

Figure 1:
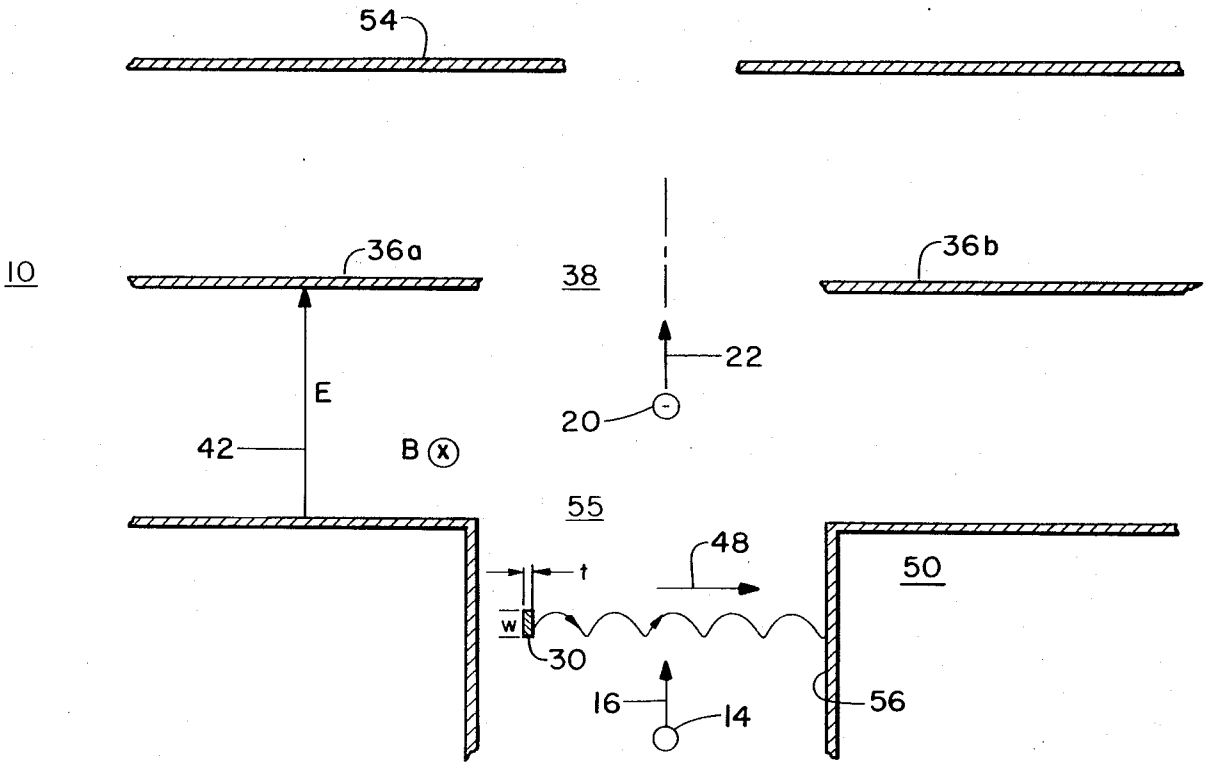
FIG. 1 is a schematic representation of a negative ion source according to the invention.

Referring now to the drawings, and especially to FIG. 1, a negative ion source 10 according to the present invention performs an electron capture process on incoming gas sample particles 14 traveling in a direction indicated by arrow 16. Particles of the incoming gas, upon capturing one or more electrons, become negative ions 20 traveling in a direction indicated by arrow 22 toward an instrument or other application requiring a negative ion species. In the preferred embodiment of FIG. 1, the end use of the negative ions is mass spectroscopic analysis in a magnetic sector mass spectrometer. A focusing lens for the spectrometer is located immediately downstream of the ion source.

Referring again to FIG. 1, ion source 10 includes a strip-like hot filament 30 for emitting electrons, having a width w, thickness t, and a length extending "into and out of the plane of the paper". The electrons emitted from filament 30 are normally attracted to a draw-out electrode 36 located downstream filament 30, and having a central aperture 38 formed therein. In the preferred embodiment, electrode 36 also comprises the first element of a focusing lens for a mass spectrometer located immediately downstream of ion source 10. Filament 30 is positioned upstream, and slightly offset from the axis of draw-out electrode 36. An external power source is applied to filament 30 and draw-out electrode 36 such that the draw-out electrode 36 is positively charged with respect to filament 30. The resulting electric field E, extending in the direction of arrow 42, tends to draw electrons emitted from filament 30 to electrode 36, and these electrons would otherwise be drawn, but for the arrangement of the present invention. A magnetic field B is oriented perpendicular to electric field E and parallel to the axis of elongated strip-like emitter 30, so as to extend into the plane of the paper. As a result of the crossed electric and magnetic fields E and B (hereinafter $E \times B$) electrons emitted from filament 30 travel in a mutually orthogonal direction, indicated by arrow 48. A shield electrode 50 is energized with a slight positive charge relative to filament 30 to provide a return path for any electrons not captured by incoming gas sample particles 14. The electric field between shield 50 and filament 30 is made negligible with respect to electric field E, so as not to disturb the $E \times B$ fields to which emitted electrons are subjected. Electrons emitted from filament 30 accelerate toward electrode 36, but if the ratio E/B is made sufficiently small, the electrons are made to move in a series of cycloidal orbits, or cycloids, which extend parallel to draw-out electrode 36. The electrons, therefore, do not reach the electrode or other components of the downstream lens, such as a second focusing lens electrode 54. FIG. 1 shows an electron moving in a curtate cycloid, [W. Bleakney and J. A. Hipple, *Phys. Rev.*, 53 (1938) 521], although prolate cycloids will predominate if the filament is rotated 90° from the configuration shown, but still extending into the plane of the paper. The type of cycloidal motion depends upon the initial velocity vectors. Calculations characterizing the electron path are made assuming that the E and B fields are constant over the flight path of the electron, although it is recognized that this is an approximation (especially with regard to the E filed) since it must be shaped in order to focus charged particles.

Electrons are initially accelerated from filament 30 at rates only slightly less than if there were no B field, so as to prevent charge buildup at the surface of the filament (electron emitter). Thermalization of the electron will occur at some distance from filament 30, and if electron capture has not occurred, the electron is reaccelerated into another cycloid, eventually terminating at the side 56 of shield electrode 50. The ionization region 55 extends between filament 30 and shield electrode 56.

Electron capture produces a negative ion with a mass 4 to 5 orders of magnitude heavier than the mass of the electron, hence the curvature of the resulting negative ion in the EXB field is much less than that of the electron. Since the magnetic field is localized in the ionization region 55, the ion leaves the ionization region before it is significantly affected by the magnetic field. The ion is accelerated into the downstream focusing lens prior to perturbation of its trajectory becoming too large for the lens to correct. It will be noted by those skilled in the art, that the physical arrangement of the present invention differs from that of a conventional electron bombardment source in that the main electron velocity component is at right angles to the magnetic field, instead of being parallel to it.

The basic equations for the forces on a charged particle in EXB fields are given by Bleakney and Hipple as cited above. The axis notation to be used here is the same as used by Bleakney and Hipple, with y being the axis in the direction of the E field, and x the direction perpendicular to the E and B fields. Using MKS units these equations are:

$$m\ddot{y}=Ee-eB\dot{x} \quad \text{(Eq. 1)}$$

$$m\ddot{x}=eB\dot{y} \quad \text{(Eq. 2)}$$

where m is the mass of an electron or charged particle, E and B are the electric and magnetic field strengths, and e is the charge of an electron. Solutions to these equations are:

$$x=x_o+a\omega t+(\dot{y}_o/\omega)(1-\cos\omega t)-(a-\dot{x}_o/\omega)\sin\omega t \quad \text{(Eq. 3)}$$

$$y=(\dot{y}_o/\omega)\sin\omega t+(a-\dot{x}_o/\omega)(1-\cos\omega t) \quad \text{(Eq. 4)}$$

$$x=a\omega+y_o\sin\omega t-(a\omega-\dot{x}_o)\cos\omega t \quad \text{(Eq. 5)}$$

$$\dot{y}=\dot{y}_o\cos\omega t(a\omega-\dot{x}_o)\sin\omega t \quad \text{(Eq. 6)}$$

$$\omega=eB/m \text{ (dimensions are } s^{-1}) \quad \text{(Eq. 7)}$$

$$a=mE/EB^2 \text{ (dimensions are meters)=cycloidal radius} \quad \text{(Eq. 8)}$$

$$a\omega=E/B \text{ (dimensions are meter/s)} \quad \text{(Eq. 9)}$$

The quantities $\dot{x}_o$ and $\dot{y}_o$ are the injection velocities in the respective directions, and $2\pi a$ is the distance between cycloids on the x axis. The aforementioned paper by Bleakney and Hipple may be referred to for a discussion of the derivations and the cycloidal trajectories.

The equations need only describe motion in two dimensions, since motion in the third dimension (z axis) will only result in a drift with the initial z axis velocity, $\dot{z}_o$. As will be shown later, $\dot{z}_o$ must be included only when calculating the total kinetic energy of the electron. This is a result of the x and y velocity vectors being reduced to much less than the initial values, so that $\dot{z}_o$ supplies most of the residual kinetic energy.

Combining Equations 5 and 6 give Equation 10, the two dimensional velocity.

$$v^2=\dot{x}^2+\dot{y}^2= \quad \text{(Eq. 10)}$$

$$v_o^2+2a^2\omega^2-2a\omega\dot{x}_o+2a\omega[\dot{y}_o\sin\omega t-a\omega\cos\omega t+\dot{x}_o\cos\omega t]$$

$$\text{where } v_o^2=x_o^2+y_o^2 \quad \text{(Eq. 11)}$$

An alternate form of Equation 10 is:

$$v^2=v_*^2+ \quad \text{(Eq. 12)}$$

$$2a\omega\sum_{n=1}^{\infty}(-1)^n\left[\frac{\dot{x}_o(\omega t)^{2n}}{(2n)!}+\frac{\dot{y}_o(\omega t)^{2n+1}}{(2n+1)!}+\frac{a\omega(\omega t)^{2n+2}}{(2n+2)!}\right]$$

$$\text{where } v_*^2=\left[\dot{y}_o+\frac{Eet}{m}\right]^2+\dot{x}_o^2 \quad \text{(Eq. 13)}$$

Equation 10 is the most desirable form for calculating velocity for finite B fields, but is indeterminate for B=0. The usefullness of Equation 12 comes from its ability to describe qualitatively the velocity retardation effect of the magnetic field. The summation term approaches zero as B approaches zero, leaving v*, which is the term for movement of a charged particle in an E field without a B field (Equation 13). The summation term can be shown to become an increasingly larger negative number as B increases. Hence, velocity is always retarded by a finite B field, and this retardation increases with B.

The initial velocity vectors and the a (E/B) term determine the maximum and minimum velocity. Holding these constant, Equation 10 becomes:

$$v^2=A+B\sin\omega t+C\cos\omega t \quad \text{(Eq. 14)}$$

where A, B and C are constants. The consequence of this is that the magnitude of the velocity does not vary with changing E and B fields as long as E/B is held constant, although the cycloidal radius, a, changes proportionally with $E/B^2$, or with 1/B since E/B is constant.

The magnitude of the initial velocity vectors effects velocity throughout the cycloidal orbit, and this effect becomes more pronounced as E/B decreases. The consequence is that the electron emitter temperature should be as low as possible, consistant with the required electron flux.

The initial values of the velocity vectors are governed by the temperature of the emitting filament. Electrons are emitted with a kinetic energy of kT in the direction perpendicular to the surface, and ½ kT along each of the other axes [A. J. Dekker, Solid State Physics, Prentice-Hall, Inc., Englewood Cliffs, N.J.]. These are average kinetic energies with Maxwellian distributions. Velocity is calculated by setting the kinetic energy equal to $\frac{1}{2}mv^2$. The effective temperature of the emitted electrons is 3/2 kT. Thus, the electron temperature is greater than the temperature of the emitting filament, corresponding to the extra ½ kT of kinetic energy in the direction perpendicular to the surface.

The lowest emitter temperature at which approximately 10 microamperes of electron current can be produced is 1300 K, [J. E. Delmore, *Int. J. Mass Spectrom. Ion Phys.*, 43 (1982) 273]. Table I summarizes the energy equations and the velocities at 1300 K for the x, y and z coordinates:

TABLE I

ENERGY RELATIONSHIPS AND ELECTRON VELOCITIES AT 1300 K

| Angle To | Energy | | | Velocity × $10^5$ meters/s | | |
|---|---|---|---|---|---|---|
| Drawout Electrode | X | Y | Z | $X_o$ | $Y_o$ | $Z_o$ |
| 0 | ½ kT | kT | ½ kT | 1.41 | 1.99 | 1.41 |
| 45 | ¾ kT | ¾ kT | ½ kT | 1.72 | 1.72 | 1.41 |
| 90 | kT | ½ kT | ½ kT | 1.99 | 1.41 | 1.41 |

The electron temperatures in the following Table II, corresponding to the minimum kinetic energy (or velocity), are calculated using Equation 15.

$$3/2\ kT=\tfrac{1}{2}m(\dot{x}^2+\dot{y}^2+\dot{z}^2) \quad \text{(Eq. 15)}$$

TABLE II

MINIMUM ELECTRON TEMPERATURES (C) FOR VARIOUS MAGNETIC (B) FIELDS AND ANGLES

| | Angle of Filament to Ion Lens | | |
|---|---|---|---|
| B (Gauss) | 0° | 45° | 90° |
| 300 | 343 | 563 | 787 |
| 400 | 255 | 424 | 654 |
| 500 | 225 | 340 | 538 |

These electron temperatures are only approximations, because the Maxwellian distributions have probably been perturbed, and only the case of the average velocity has been considered. Nevertheless, these electron temperatures should be reasonable approximations for comparison to the temperature of gas molecules with which they may react.

The ratio E/B (aω) is the most important parameter in determining velocity (or kinetic energy) during a cycloidal orbit. An electric field of $1.57\times10^4$ V/meter was found to give optimum sensitivity in the magnetic sector mass spectrometer used to verify the calculations—therefore, this value is used in all calculations and the magnetic field is allowed to vary.

Figure 2:
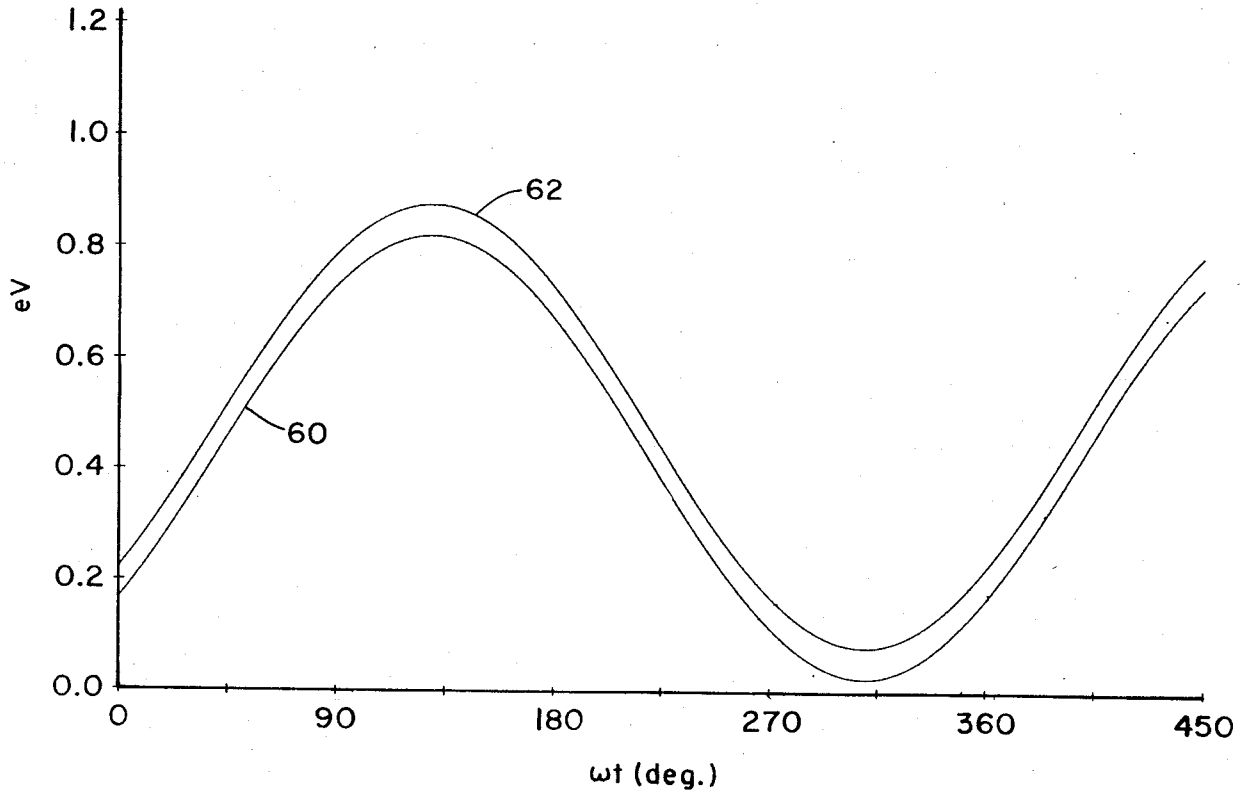
FIG. 2 is a plot of two and three dimensional kinetic energy curves versus cycloidal angle, for the arrangement of FIG. 1.

FIG. 2 is a plot of the two and three dimensional kinetic energy curves labeled 60, 62, respectively for B=500 gauss ($5.10^{-2}$ Webers/meter$^2$ in MKS) and the electron emitter or filament 30 oriented at 45° to the drawout electrode of the lens (reference numeral 366). The percentage difference between the two and three dimensional kinetic energy curves is not great, except in the region close to the minimum, which in this case occurs at $\omega t=309.55°$. The electron temperature at this point corresponds to 613 K for the three dimensional model, and 179 K for the two dimensional model. Thus, it is seen that most of the residual kinetic energy at the minimum comes from $z_0$. All additional kinetic energy calculations will be in three dimensions.

Figure 3:
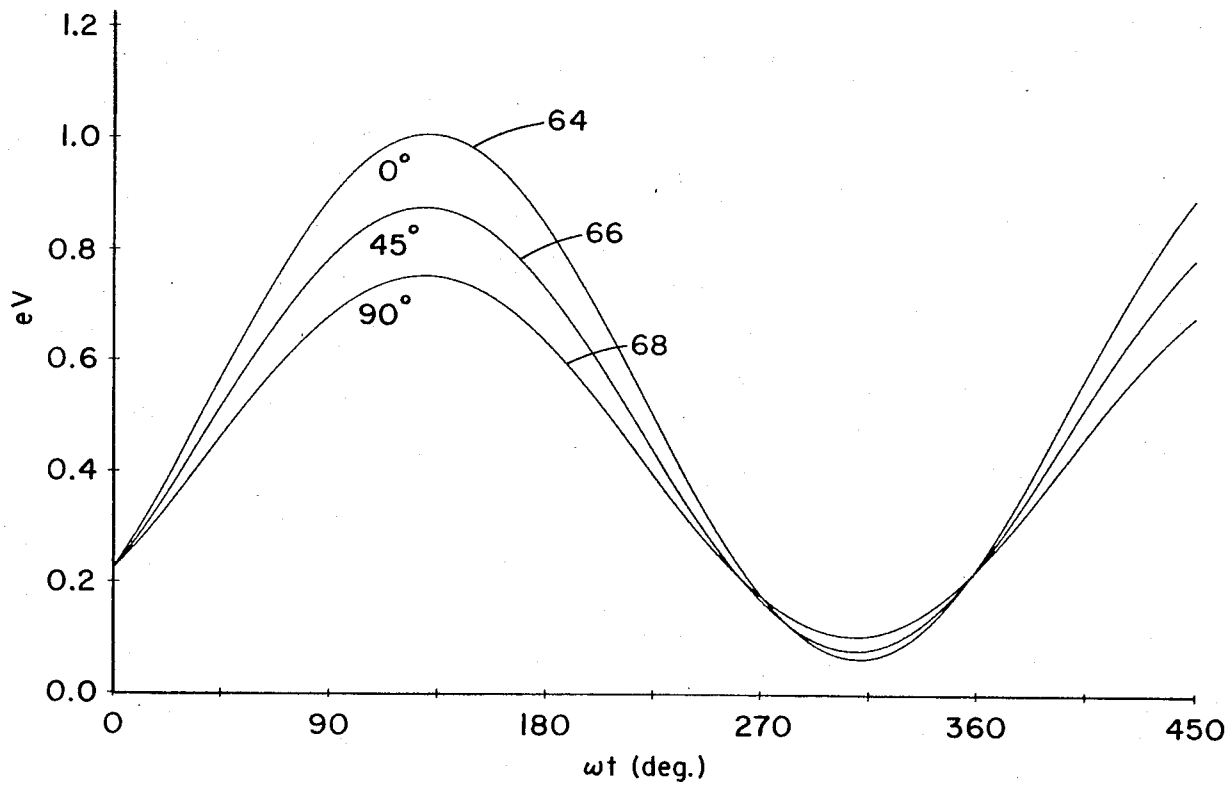
FIG. 3 is a plot of three dimensional electron kinetic energy versus cycloidal angle for the arrangement of FIG. 1.

FIG. 3 is a plot of kinetic energy vs. cycloidal angle at 500 gauss for the electron emitter at 0°, 45° and 90° to the drawout electrode (numerals 64, 66, 68, respectively). The differences are due to the different injection velocities in the x and y directions, which in turn arise from the electron being emitted with twice the kinetic energy in the direction perpendicular to the surface as in the other directions. The maximum kinetic energy occurs in the reverse order for the three angles. Thus, the 0° angle produces electrons with the broadest envelope of energies. Electron temperatures for the minima are shown in Table II (above) for various conditions.

Figure 4:
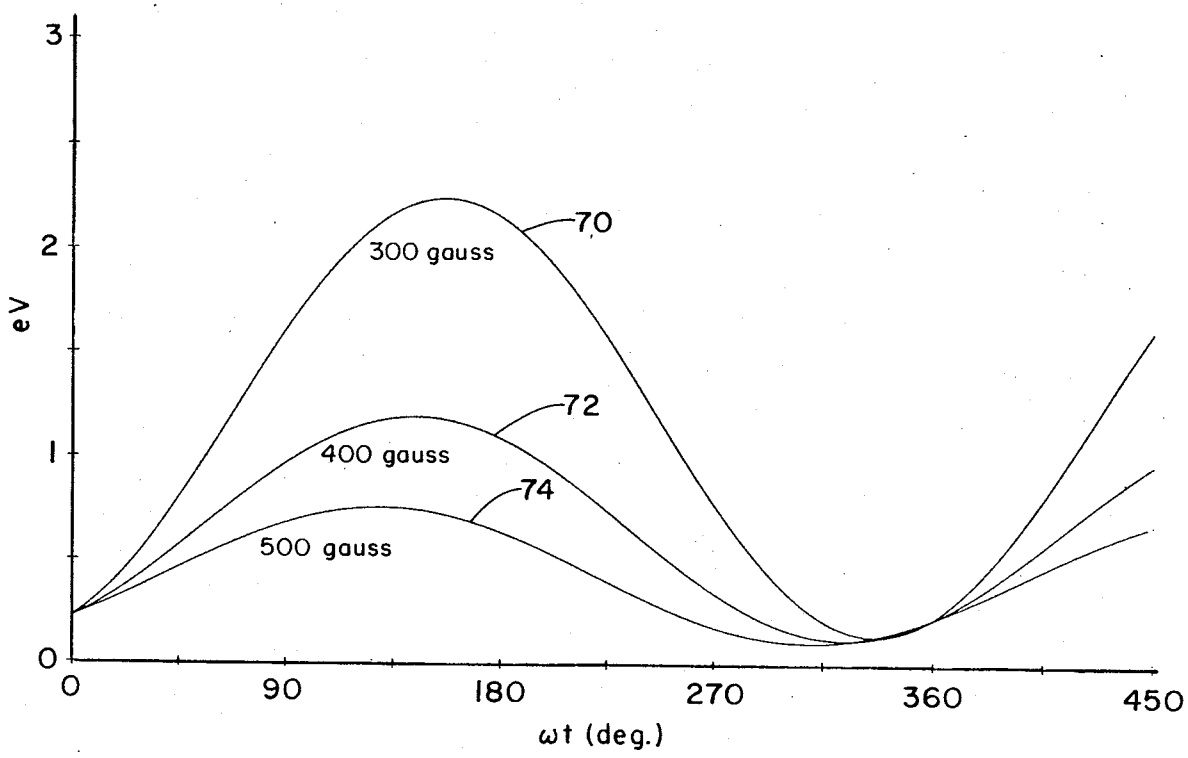
FIG. 4 is a plot of three dimensional electron kinetic energy versus cycloidal angle for a 45° electron emitter orientation.

FIG. 4 is a plot of the electron kinetic energy vs. cycloidal angle for 300, 400 and 500 gauss fields with the filament at 45° (numerals 70, 72, 74, respectively). Electron capture cross sections are not known as a function of electron energy for many gases, although it is generally assumed that most cross sections increase as the electron energy decreases to "thermal" energies. The 500 gauss curve 74 in FIG. 4 obviously has a larger component at low energies than the others. Therefore, for the electric fields used in these calculations, 500 gauss or more should produce higher electron capture rates than the lower fields. Use of this great a magnetic field (for the given electric field) may impart sufficient curvature to heavy negative ions, thereby requiring provision for re-centering the ion beam in the ion lens.

The distance between cycloidal centers is $2\pi a$, where "a" is the cycloidal radius given above in Eq. 8. The distance is independent of initial velocity (which is the feature that accounts for the double focusing properties of the cycloidal mass spectrometer) and therefore the distance is independent of the filament angle and temperature. This distance decreases with the square of the magnetic field. Table III gives these distances for various magnetic fields and the number of cycles completed in 2.5 mm (the width over which the downstream lens can accept ions is arbitrarily chosen as 2.5 mm, and varies with the lens design):

TABLE III

DISTANCE BETWEEN CYCLOIDS

| B (Gauss) | Distance (mm) | Cycles in 2.5 mm |
|---|---|---|
| 100 | 5.61 | <1 |
| 300 | 0.623 | 4 |
| 400 | 0.351 | 7 |
| 500 | 0.224 | 11 |

It should be noted that the distance between cycloids is less than the width "w" of filament 30. In the preferred embodiment, a ribbon 0.76 mm wide is used to generate electrons in the ion source. Hence, in the case where the filament is parallel (0° angle) to the drawout electrode, some of the electrons will strike the filament prior to reaching the low velocity part of the orbit. Filaments at 45° and 90° do not have this geometric obstruction.

Information on electron capture cross sections as functions of electron energies between 0 and 1 eV exists for only a few electronegative species, primarily $SF_6$ and a variety of organohologen compounds. The primary method used to measure these cross sections are the "electron-swarm unfolding" method [L. G. Christophorou, D. L. McCorkle and J. G. Carter, *J. Chem. Phys.*, 54 (1971) 253; A. A. Christodoulides, L. G. Christophorou, R. Y. Pai, and L. M. Tung, *J. Chem. Phys.*, 70 (1979) 1156; R. Y. Pai, L. G. Christophorou, and A. A. Christodoulides, *J. Chem. Phys.* 70 (1979) 1169; and D. L. McCorkle, A. A. Christodoulides, L. G. Christophorou, I. Szamrej, *J. Chem. Phys.*, 72 (1980) 4049]; and the "threshold photoelectron spectrum by electron attachment" method [J. M. Ajello and A. Chutjian, *J. Chem. Phys.*, 71 (1979) 1079; A. Chutjian, *Phys. Rev. Lett.*, 46 (1981) 1511; A. Chutjian, *J. Phys. Chem.*, 86 (1982)3518]. The cross sections that have been measured fall into two groups; those that increase nearly exponentially with decreasing electron energy, and those that are dominated by resonance capture processes at electron energies greater that 0.2 eV. The resonances are associated with certain dissociative electron capture processes.

In designing an electron capture source for the first type of process (exponential increase with decreasing energy), trons should have the lowest possible energy in order to maximize sensitivity. The second type of process (resonance capture) requires a broad range of energies in order to cover the resonances of a variety of molecules. Examination of FIG. 3 and Table II show that the electron emitting filament parallel to the drawout electrode (0°) best meets both criteria.

A drawback to having the filament at 0° is that electrons originating from certain areas of the filament will cycle back to the surface prior to reaching the region of the first orbit that has the lowest velocity. The best position might be to angle the filament just enough off 0° to allow the electrons to miss the filament. This angle is a function of the E and B fields, although 45° is sufficient to allow electrons to miss the filament under any circumstances that would produce a cycloidal orbit in the ion source. An angle between 10° and 20° allows the electrons to miss the filament under most circumstances, and is still close enough to 0° to give almost the full energy range provided by 0°.

The energy below which an electron can be called "thermalized" is arbitrarily defined as 0.2 eV for the purposes of this application. This corresponds to 1547 K. The electrons are generated with a temperature of 1733 K from a 1300 K filament, and therefore will be below 0.2 eV only while in the fourth (or 3rd and 4th) quadrant(s) of each cycloid. It should be noted that this is an average energy, with distributions above and below the average. The time per cycloid that an electron spends below 0.2 eV is listed in Table IV. A change in the 0.2 eV cutoff level can change the time appreciably, depending upon circumstances, particularly if the cutoff level is close to the minimum energy.

TABLE IV

TIME SPENT AT ENERGIES BELOW 0.2 eV FOR EACH CYCLOID AS A FUNCTION OF FILAMENT ANGLE AND MAGNETIC FIELD

| Filament | Time $\times 10^{-10}$ s. per Cycloid | | | |
|---|---|---|---|---|
| Angle | 100 Gauss | 300 Gauss | 400 Gauss | 500 Gauss |
| 0° | 0 | 1.66 | 1.77 | 1.78 |
| 45° | 0 | 1.65 | 1.70 | 1.81 |
| 90° | 0 | 1.28 | 1.60 | 1.78 |

The differences in times listed in Table IV are realatively small. The distance that a charged particle travels while traversing one cycloid decreases, along with the velocity, with increasing magnetic field. These factors approximately offset each other, and it is necessary to examine the length of time spent below the cutoff energy while traversing a given distance to get an idea of relative sensitivities that can be expected. This distance corresponds to that included by the acceptance angle of the ion lens.

Increasing magnetic fields should result in higher electron capture rates due to the increase in the number of cycloids in a given distance. Table V lists the length of time that an electron spends below 0.2 eV, for a 2.5 mm distance, as a function of magnetic field. The time increases approximately with the square of the magnetic field for this range of electric and magnetic fields. This is due to the time per cycloid being nearly constant, while the number of cycloids increases with $B^2$.

TABLE V

TIME SPENT AT ENERGIES BELOW 0.2 eV IN TRAVERSING 2.5 mm AS A FUNCTION OF FILAMENT ANGLE AND MAGNETIC FIELD

| Filament | Time $\times 10^{-10}$ s per Cycloid | | | |
|---|---|---|---|---|
| Angle | 100 Gauss | 300 Gauss | 400 Gauss | 500 Gauss |
| 0° | 0 | 6.64 | 12.39 | 19.58 |
| 45° | 0 | 6.60 | 11.87 | 19.86 |
| 90° | 0 | 5.12 | 11.20 | 19.58 |

Realistic calculations of relative electron capture sensitivities requires a knowledge of electron capture cross sections as a function of energy, and these are available for only a few molecules. Relative electron capture sensitivities would be calculated by (1) Intergrating cross sections over the Maxwellian electron energy distributions. (2) Rationing these integrals for different gases to get relative sensitivities. These calculations would not be exact, however, due to the shaping of the E field used to focus ions in the lens.

It may be possible to measure electron capture cross sections by reversing this procedure: measure relative sensitivities for different gases, and unfolding relative cross section data from this information. This procedure would have to be carried out over a range of electric and magnetic fields to obtain the variations in cross sections with electron energy. The procedure could not be used in a conventional ion source because the shaped electric fields used to focus ions would result in an ambiguous electron energy calculations. An ion chamber would be required that has highly uniform electric and magnetic fields, and operates with electron currents low enough not to seriously perturb either field. This type of measurement would be most easily carried out with an ionization chamber that either did not employ mass analysis, or used a pinhole aperture to enter a mass analyzer so as not to perturb the electric field.

The ultimate limitation for any electron capture ion source for mass spectrometry is charge density defocusing. This was determined to be the case for the relatively simple source reported by J. E. Delmore, inventor of the present invention [J. E. Delmore, *Int. J. Mass Spectrom. Ion Phys.*, 43 (1982) 71]. Discussions of similar space charging effects from ions in cycloidal mass spectrometers have been published by Bleakney and Hipple [W. Bleakney and J. A. Hipple, *Phys. Rev.*, 53 (1938) 521] and by Robinson [C. F. Robinson, *Rev. Sci. Instrum.*, 27, (1956) 512]. The basic problem is that electrons are not readily captured by most molecules unless they have low kinetic energy, and at this low energy they remain in an area for a longer period of time, causing a charge accumulation in that region. Mutual charge repulsion tends to expand the electron cloud, along with negative ions. The mass spectrometer used to analyze the negative ions will have a certain acceptance angle, and when the negative ions are repulsed a smaller percentage will be within this angle. Thus, this type of source would be expected to be most effective when operated with an ion lens and mass analyzer with a relatively large angle of acceptance and a strong E field to extract ions rapidly.

Designing an ion source using the EXB concept requires a judicious choice of E and B fields, hence it is worth examining the trends when varying these parameters. First, a range of electron velocities must be chosen. For given initial electron velocity vectors, subsequent velocity is determined entirely by E/B ($a\omega$). Hence, increasing E requires a corresponding increase in B in order to keep the velocity envelope constant. Increasing E and B proportionally will increase the number of cycloids in a given distance, since the cycloidal radius decreases as $E/B^2$. The larger E field will also extract ions from the electron cloud in less time, reducing the defocusing effect of space charge.

All of these criteria indicate that higher E and B fields will increase the sensitivity of the ion source. There are several constraints as to how large these fields can be, however. The limits on the B field are the physical size of the magnet in a confined space, and the curvature of the ions. Excessive curvature would require scanning deflection plates in the ion source simultaneous with scanning the mass spectrometer. Although this has been done in certain commercial instruments, it is a considerable complication. The main limit on the magnitude of the E field in the preferred embodiment is the requirement that the source interface to a mass spectrometer. This is a more serious problem for a quadrupole than for a magnetic sector mass spectrometer, due to the requirement of low velocity during transit through the quadrupole. This could be circumvented by accelerating, then partially decelerating the ions prior to entering the quadrupole.

Early versions of the present invention, an experimental ion source using the EXB concept, utilized an arrangement similar to that reported by J. D. Delmore, inventor of the present invention [J. E. Delmore, *Int. J. Mass Spectrom. Ion Phys.*, 43 (1982) 71] with respect to $SF_6$ electron capture, but with the addition of a permanent magnet to produce a magnetic field localized in the ionization region. This arrangement, however is not preferred over that embodiment described above.

The magnetic field was varied from about 5 gauss (residual field) up to 500 gauss by the permanent magnets used to energize the magnet gap. The sensitivity of $SF_6$ for electron capture increased approximately one order of magnitude when increasing the field from 5 to 300 gauss, although the emitter temperature required to obtain optimum sensitivity decreased from 1470 K to 1320 K. Presumably, the lower emitter temperature corresponds to a lower total electron flux. This decrease in optimum emitter temperature is consistent with the concept of space charge effects causing more problems as the electrons move more slowly. Thus, space charging effects partially offset gains from increased electron capture rates, and provide a design limitation that must be considered.

Optimum sensitivity was obtained with an ion lens drawout voltage approximately twice ($1.57 \cdot 10^4$ vs. $7.8 \cdot 10^3$ V/meter) that used for normal operation [J. E. Delmore, *Int. J. Mass Spectrom. Ion Phys.*, 43 (1982) 273]. This is consistent with the concept of a high E field being required to extract ions from the electron cloud prior to the ions being dispersed in directions other than into the ion lens. One limitation of the magnitude of the E field is the requirement that the focusing properties of the rest of the lens not be perturbed. The particular lens used for this study was designed to focus with a relatively low drawout voltage and it was not possible to increase the E field in the ionization region beyond a factor of two without seriously perturbing the focusing properties of the lens.

It has been assumed that a hot filament for emitting electrons will be present within the ionization chamber. This is the simplest physical arrangement and works well for relatively stable molecules like $SF_6$, especially if the filament is moved off-axis (as in FIG. 1) so as not to dissociate the gas at the focal point of the lens. Nevertheless, this arrangement could lead to complications in the mass spectra of less stable molecules. An additional complication is the heating effect of the hot filament, since electron capture is a favored process not only for low electron temperatures, but also for low gas temperatures in some instances [B. J. Miwa, W. A. Garland and P. Blumenthal, *Anal. Chem.*, 53 (1981) 793].

A method for circumventing these problems is to move the filament from the ionization region to behind a slit and out of the magnetic field. The electron beam is then accelerated to a few electron volts, its position adjusted by centering/deflection electrodes, and decelerated to a few tenths of an eV as it enters the magnetic field. The EXB field then confines the electrons in cycloidal paths with a corresponding variation in kinetic energy. The advantages of this configuration are the removal of the major heat source from the ionization region, the elimination of fragmentation problems, and the removal of electrons with excessive x axis velocity by collimation.

As can be seen that the present invention describes a method and apparatus for converting gas molecules into negative ions for analysis in a mass spectrometer. Normally, emmitter electrons are too energetic to be susceptible to the mechanism of electron capture, but rather, act upon gaseous molecules by bombardment. The incorporation of a magnetic field in the present invention serves to slow the electrons to an energy level at which they can be captured. The resulting negative ions are sufficiently massive that their trajectories are unaffected by the magnetic field. Hence an underlying principle of the present invention is to accelerate a charged particle, namely an electron, with crossed electric and magnetic fields. The electron moves in a cycloidal trajectory, wherein its velocity is reduced to a small fraction of the original velocity. Electrons are produced at minimum temperatures at about 1700° C., but are reduced to less than 200° C. as they traverse this cycloidal orbit. Electrons are readily captured by many gas molecules when the effective temperature is reduced to these levels.

The embodiment of the invention in which an exlusive property or privilege is claimed are defined as follows:

1. An apparatus for producing negative ions of a gaseous sample comprising:

an electron emitter;

a draw-out electrode lying in a first plane and having an axis extending perpendicular to said first plane;

a chamber having an ionization region and containing said electron emitter in said ionization region and containing said draw-out electrode removed from said ionization region;

means for providing at least between said electron emitter and said draw-out electrode, an electric field aligned with said axis of said draw-out electrode and oriented to attract negative particles toward said draw-out electrode;

means for providing in said ionization region of said chamber, a uniform magnetic field orthogonal to said electric field throughout said ionization region, such that when a gaseous sample is introduced into said ionization region of said chamber, and electrons are emitted from said electron emitter, said electrons accelerate toward said draw-out electrode under the influence of said electric field, said magnetic field causes said moving electrons to travel in a direction orthogonal to said magnetic and electric fields, with a generally cycloidal trajectory effected by said orthogonal electric and magnetic fields, molecules of said gaseous sample capture said cycloidally moving electrons to become negative ions which are preferentially accelerated by said electric field toward said draw-out electrode, free electrons not captured being retained in said ionization region.

2. The arrangement of claim 1 wherein the electric field produced by said electric field means and the magnetic field produced by said magnetic field means cause are such that said electrons travel in a curtate cycloidal orbit in a direction generally perpendicular to said axis of said draw-out electrode.

3. The arrangement of claim 1 wherein the electric field produced by said electric field means and the magnetic field produced by said magnetic field means cause are such that said electrons travel in a prolate cycloidal orbit in a direction generally perpendicular to said axis of said draw-out electrode.

4. The arrangement of claim 1 wherein said electron emitter comprises a generally strip-like elongated filament extending in a direction parallel to said magnetic field and having a width extending in the general direction of said electric field, said electrons being emitted from said filament and traveling across said gas stream in a plurality of cycloidal orbits, with the distance between cycloidal orbits being greater than the width of said filament.

5. The arrangement of claim 1 wherein said emitter has a width extending in a predetermined direction which lies at an angle ranging between 0° and 20° with respect to said axis of said draw-out electrode.

6. The arrangement of claim 1 wherein said drawout electrode comprises a first element of a focusing lens for focusing said negative ions.

7. The arrangement of claim 1 wherein said draw-out electrode includes an aperture through which particles can pass.

8. The arrangement of claim 1 further comprising a shield electrode, spatially separated from said draw-out electrode and said electron emitter, for capturing electrons not captured by said gaseous sample.

9. A method of producing negative ions of a gaseous sample comprising:

providing a chamber having an ionization region and containing an electron emitter in said ionization region and containing a planar draw-out electrode lying in a first plane removed from said ionization region, said draw-out electrode having an axis perpendicular to said plane;

providing to the interior of said chamber at least between said electron emitter and said draw-out electrode, an electric field aligned with the axis of said draw-out electrode;

providing to said ionization region of said chamber a uniform magnetic field aligned orthogonally to said electric field throufront said ionization region introducing a gaseous sample into said ionization region of said chamber; and providing energy to said emitter to cause electrons to be emitted therefrom into said ionization region, said orthogonal electric and magnetic fields, of predetermined strengths to cause said emitted electons to travel in generally cycloidal trajectories such that the molecules of said gaseous sample capture said electrons to become negative ions which are preferentially accelerated by said electric field toward said draw-out electrode.

10. The method of claim 9 wherein said electric and magnetic fields are of such value that said electrons travel in a curtate cycloidal orbit in a direction generally perpendicular to said axis of said draw-out electrode.

11. The method of claim 9 wherein said electric and magnetic fields are of such value that said electrons travel in a prolate cycloidal orbit in a direction generally perpendicular to said axis of said draw-out electrode.

12. The method of claim 9 wherein said electron emitter comprises a generally strip-like elongated filament extending in a direction parallel to said magnetic field and having a width extending in the direction of said electric field, said electrons being emitted from said filament traveling across said gas stream in a plurality of cycloidal orbits, with the distance between cycloidal orbits being greater than the width of said filament.

13. The method of claim 9 wherein said emitter has a width extending in a predetermined direction which lies at an angle ranging between 0° and 20° with respect to said axis of said draw-out electrode.

14. The method of claim 9 wherein said drawout electrode comprises a first element of a focusing lens for focusing said negative ions.

* * * * *